US007028758B2

(12) United States Patent
Sheng et al.

(10) Patent No.: US 7,028,758 B2
(45) Date of Patent: Apr. 18, 2006

(54) HEAT DISSIPATING DEVICE WITH HEAT PIPE

(75) Inventors: Jian-Qing Sheng, Shenzhen (CN); Meng-Tzu Lee, Tu-Cheng (TW); Shu-Ho Lin, Tu-Cheng (TW)

(73) Assignee: HON HAI Precision Industry Co., Ltd., (TW)

( * ) Notice: Subject to any disclaimer, the term of this patent is extended or adjusted under 35 U.S.C. 154(b) by 0 days.

(21) Appl. No.: 11/019,340

(22) Filed: Dec. 21, 2004

(65) Prior Publication Data

US 2005/0263265 A1 Dec. 1, 2005

(30) Foreign Application Priority Data

May 26, 2004 (CN) ..... 200410027404

(51) Int. Cl.
*F28D 15/00* (2006.01)

(52) U.S. Cl. ..... 165/104.21; 165/104.26; 165/104.33; 361/700; 361/697; 174/15.2; 257/715

(58) Field of Classification Search ..... 165/104.33, 165/104.21, 104.19, 80.4; 361/697, 699, 361/700, 704; 257/714–716
See application file for complete search history.

(56) References Cited

U.S. PATENT DOCUMENTS

| | | | | |
|---|---|---|---|---|
| 6,102,110 | A * | 8/2000 | Julien et al. | 165/104.33 |
| 6,189,601 | B1 * | 2/2001 | Goodman et al. | 165/80.3 |
| 6,226,178 | B1 | 5/2001 | Broder et al. | |
| 6,394,175 | B1 | 5/2002 | Chen et al. | |
| 6,651,734 | B1 * | 11/2003 | Liu | 165/80.3 |
| 6,830,098 | B1 * | 12/2004 | Todd et al. | 165/104.33 |
| 6,894,900 | B1 * | 5/2005 | Malone | 361/700 |
| 6,909,608 | B1 * | 6/2005 | Fan | 361/700 |
| 2003/0019610 | A1 * | 1/2003 | Liu | 165/80.3 |
| 2004/0050534 | A1 | 3/2004 | Malone et al. | |
| 2004/0114329 | A1 * | 6/2004 | Chen | 361/704 |
| 2004/0182552 | A1 * | 9/2004 | Kubo | 165/104.33 |

* cited by examiner

*Primary Examiner*—Terrell Mckinnon
(74) *Attorney, Agent, or Firm*—Morris, Manning & Martin, LLP; Tim Tingkang Xia, Esq.

(57) ABSTRACT

A heat dissipating device incorporating heat pipes is disclosed. The heat dissipating device includes a base, a plurality of heat-dissipating fins and at least one heat pipe. The heat pipe includes an evaporating portion attached to the base, a middle-portion and a condensing portion extending through the fins. Bottoms of the evaporating portion of the heat pipe and the base are coplanar, and the condensing portion extends opposite to the evaporating portion.

18 Claims, 3 Drawing Sheets

HEAT DISSIPATING DEVICE WITH HEAT PIPE

TECHNICAL FIELD

The present invention relates generally to heat dissipating devices for removing heat from heat-generating devices, and more particularly to a heat dissipating device incorporating with heat pipes for promoting heat dissipation effect thereof

BACKGROUND

Computer electronic devices such as central processing units (CPUs) generate lots of heat during normal operation. If not properly removed, such heat can adversely affect the operational stability of computers. Solutions must be taken to efficiently remove the heat from the CPUs. Typically, a heat sink is mounted on a CPU to remove heat thereon, and a fan is often attached to the heat sink for improving heat-dissipating efficiency of the heat sink. The heat sink commonly comprises a base and a plurality of heat-dissipating fins arranged on the base.

Nowadays, CPUs and other related computer electronic devices are becoming functionally more powerful and more heat is produced consequently, resulting in an increasing need for removing the heat away more rapidly. Conventional heat sinks made of metal materials, even a fan is used, gradually cannot satisfy the need of heat dissipation. Accordingly, another kind of heat dissipating device incorporating with heat pipes has been designed to meet the current heat dissipation need, as the heat pipe possesses an extraordinary heat transfer capacity and can quickly transfer heat from one point to another thereof Commonly, a heat pipe consists of a sealed aluminum or copper container with the internal walls lined with a capillary wick structure that is filled with a working fluid. As the heat pipe absorbs heat at one end thereof fluid is vaporized, and a pressure gradient is formed in the pipe. This pressure gradient forces the vapor to flow along the pipe from the one end to the other end where the vapor condenses and gives out its latent heat of vaporization. The working fluid is then returned back to the one end of the pipe via the capillary forces developed in the wick structure. When used, an end of the heat pipe is attached to the base of a heat sink, and the other end of the heat pipe is attached to a plurality of heat-dissipating fins of the heat sink. Thus the heat generated by electronic devices is conducted to the base and then rapidly transferred to the heat-dissipating fins via the heat pipe for further dissipating to ambient air.

However, the above-mentioned heat dissipating device incorporating with heat pipes has a disadvantage that it exists a big thermal resistance between the heat pipe and an electronic device, which decreases the heat dissipation efficiency of the heat dissipating device.

Therefore, it is desired to design a novel heat dissipating device to overcome the aforementioned problems and increase the heat dissipation effect thereof

SUMMARY

Accordingly, an object of the present invention is to provide a heat dissipating device incorporating with heat pipes which decreases heat resistance between the heat pipe and an electronic device to increase the heat dissipation efficiency thereof In order to achieve the object above, a heat dissipating device for removing heat from heat-generating component in accordance with the present invention comprises a base, a plurality of heat-dissipating fins and at least one heat pipe. The heat pipe comprises an evaporating portion attached to the base, a middle-portion and a condensing portion extending through the fins. Bottoms of the evaporating portion of the heat pipe and the base are coplanar, and the condensing portion extends opposite to the evaporating portion.

Other objects, advantages and novel features of the present invention will become more apparent from the following detailed description when taken in conjunction with the accompanying drawings, in which:

DETAILED DESCRIPTION

Figure 1:
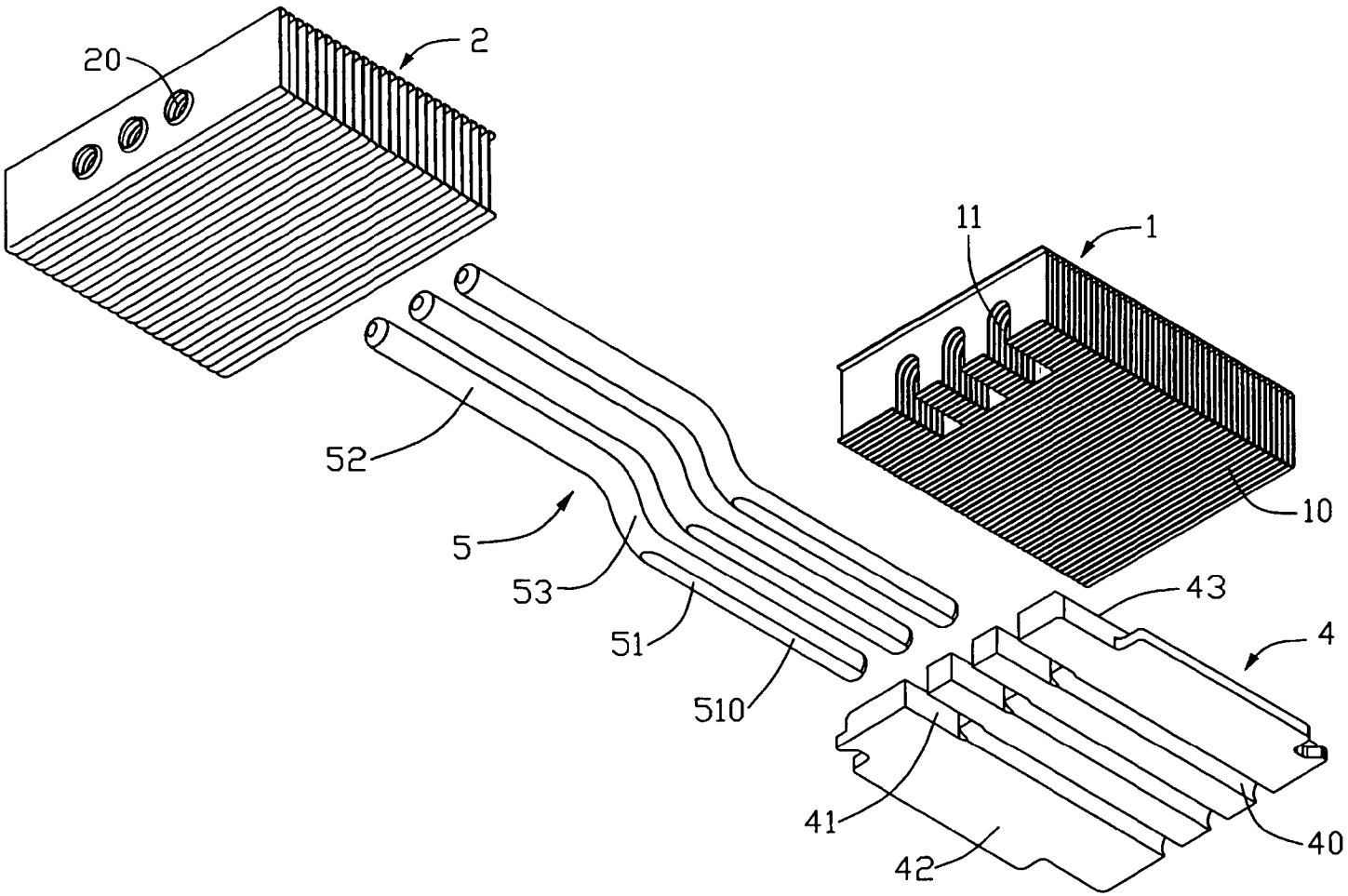
FIG. 1 is an exploded, isometric view of a heat dissipating device in accordance with one preferred embodiment of the present invention.

Reference will now be made to the drawing figures to describe the present invention in detail.

Figure 2:
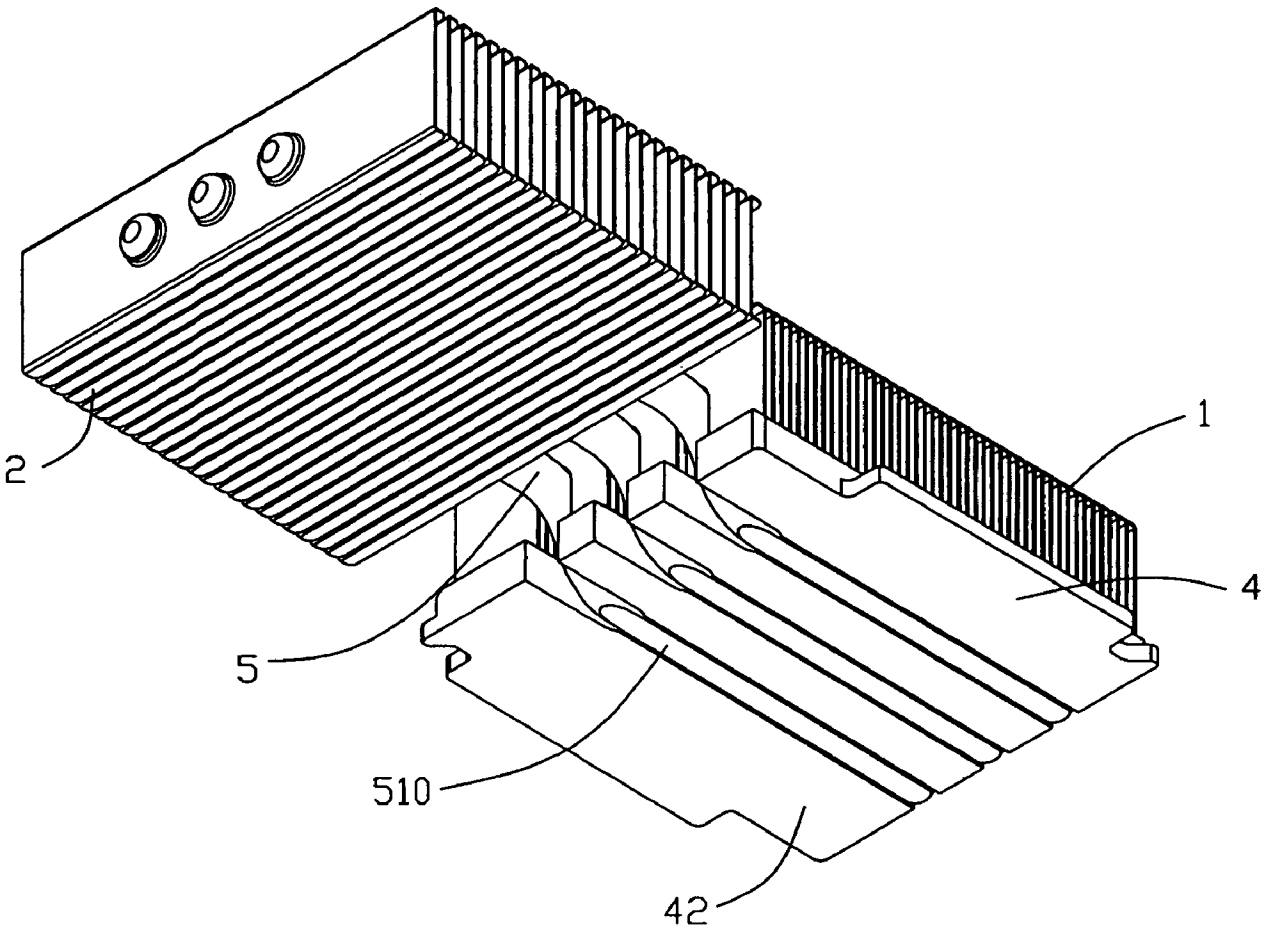
FIG. 2 is an assembled view of the heat dissipating device of FIG. 1.

FIG. 1–2 show a preferred embodiment of a heat dissipating device in accordance with present invention. The heat dissipating device comprises two heat sinks 1, 2, a heat receiver such as a base 4, three heat pipes 5 thermally connecting the base 4 with the heat sinks 1, 2.

The base 4 has a top surface 43 and a bottom surface 42 opposite to the top surface 43. The bottom surface 42 of the base 4 is planar for contacting a heat-generating component (not shown). The base 4 defines three grooves 40 in the bottom surface 42 thereof One end of the base 4 defines three gaps 41 in connection with the grooves 40. The gaps 41 are extended through the top and bottom surfaces 42, 43 of the base.

Each heat pipe 5 is tube-shaped and has an evaporating portion 51, a middle-portion 53 and a condensing portion 52 extending opposite to the evaporating portion 51. The middle-portion 53 is a curved-portion. The evaporating portion 51 of the heat pipe 5 defines a plane surface 510 directly contacting the heat-generating component. The plane surface 510 is coplanar with the bottom surface 42 of the base 4. The roughness of the plane surface 510 and the bottom surface 42 is better less than 0.08mm. Then, the plane surface 510 can intimately contact the heat-generating component. The plane surface 510 is made by means of precision machining, such as milling. The condensing portion 52 is extended parallel to the plane surface 510, which can save room along a direction perpendicular to the plane surface 510.

The heat sinks 1, 2 each comprise a plurality of parallel fins. The heat sink 1 comprises a face 10 facing the top surface 43 of the base 4. Three U-shaped cavities 11 are defined in an end of the heat sink 1. The middle-portions 53 of the heat pipe 5 are engaging with the heat sink 1 in the cavities 11. The heat sink 2 defines holes 20 therein.

In assembly, The heat sink 1 is attached to the top surface 43 of the base 4. Said end of the heat sink 1 where the cavities 11 are defined is aligned with said end of the base 4 where the gaps 41 are defined. The evaporating portions 51 of the heat pipes 5 are thermally engaged in the slots 40 of the base 4, with part thereof exposed beyond the base 4. The exposed part of the evaporating portions 51 and the bottom surface 42 of the base 4 are simultaneity milled to form the plane surfaces 510 which is coplanar with the bottom surface 42 of the base 4. The heat sink 1 is thermally mounted on the top surface 43 of the base 4. The cavities 11 of the heat sink 1 are engaged with the middle-portions 53 extending through the gaps 41 of the base 4. The condensing portions 52 are thermally inserted in the holes 20 of the heat sink 2. The evaporating portions 51, the middle-portions 53 and the condensing portions 52 might be engaged in the slots 40, cavities 11 and the holes 20 respectively, by means of soldering, bonding, or be interferentially received respectively in the slots 40, cavities 11 and the holes 20.

Referring to FIGS. 1–2, when used, the base 4 might be in thermally conductive relation to the heat-generating component. The heat pipes 5 directly absorb heat from the heat-generating component via the evaporating portion 51, and transfer the heat to the heat sink 2 via the condensing portions 52 and to the heat sink 1 via the base 4. The base 4 also absorbs heat from the heat-generating component and transfers the heat to the heat sink 1. The heat on the heat sink 1, 2 is further radiated to ambient air via the fins thereon.

Figure 3:
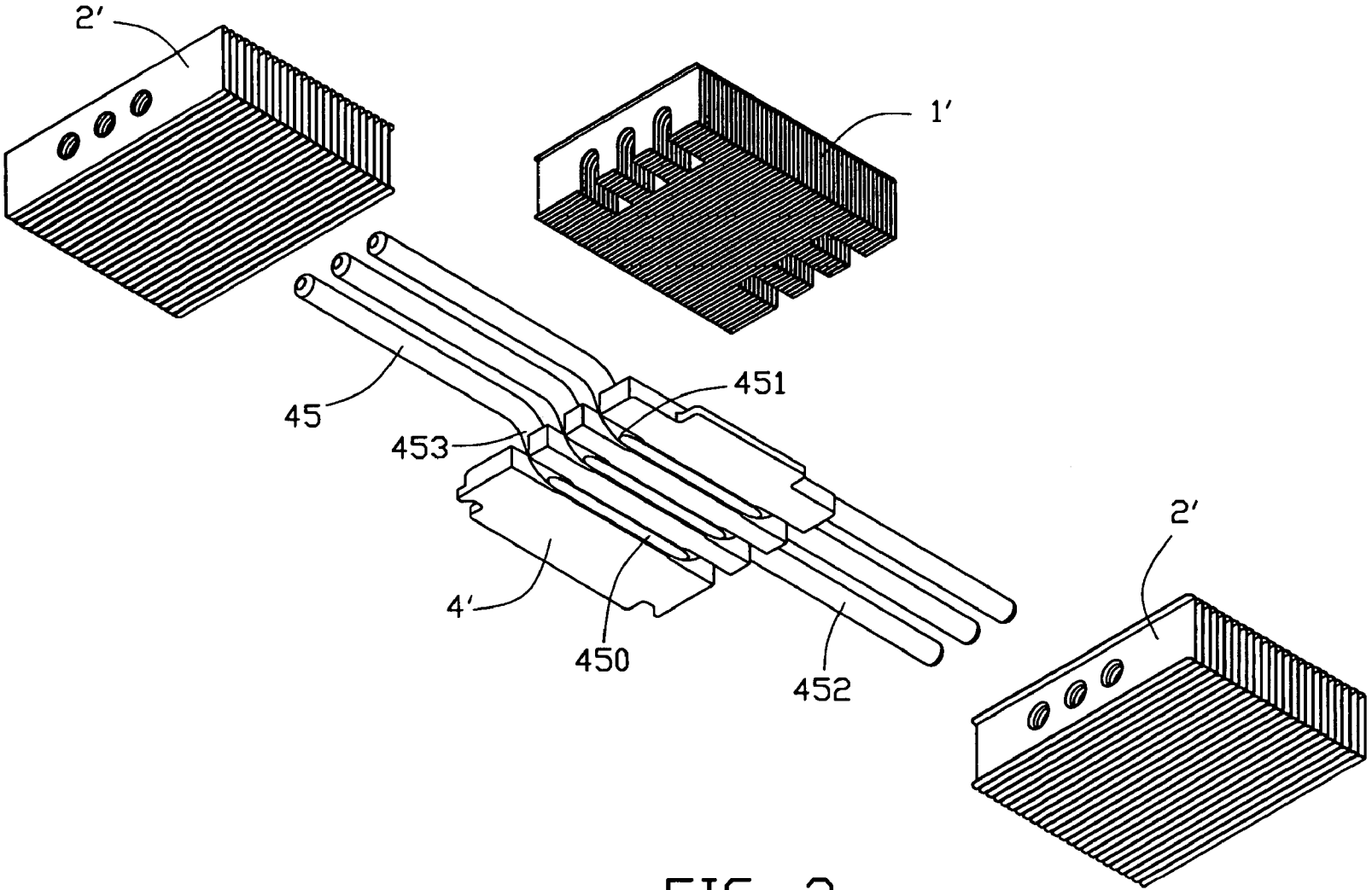
FIG. 3 is an exploded, isometric view of a heat dissipating device in according with an alternative embodiment of the present invention.

As illustrated in FIG. 3, two heat sinks 2' are used. Each heat sink 2' is almost the same as the heat sinks 2 of FIG. 1. Each heat pipe 45 has an evaporating portion 451 attached to a corresponding groove defined in a base 4', two condensing portions 452 and two middle-portions 453 thermally connecting the evaporating portion 451 to the condensing portions 452. The evaporating portion 451 has a plane surface 450 directly contacting a heat-generating component. Two condensing portions 452 respectively thermally contact the heat sink 2'. A top surface of the base 4' thermally contacts a heat sink 1'.

The heat dissipating devices of the present invention have achieved much better heat dissipation efficiency since the surfaces 510, 450 directly contact the heat-generating component. Heat resistance between the heat pipes and the heat-generating component can be decreased Selectively, a fan unit can be attached to the heat dissipating device for providing forced airflow to further enhance the heat dissipation efficiency of the heat dissipating device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A heat dissipating device comprising:

a base having a flat bottom surface adapted for contacting with a heat generating component;

a plurality of heat-dissipating fins; and at least one heat pipe, said heat pipe comprising an evaporating portion attached to the base, a condensing portion extending through the fins and opposite to the evaporating portion, and a middle portion connecting the evaporating portion and the condensing portion, the evaporating portion of the heat pipe having a plane surface coplanar with the bottom surface of the base and adapted for contacting with the heat generating component.

2. The heat dissipating device of claim 1, wherein the middle-portion of said heat pipe is a curved-portion.

3. The heat dissipating device of claim 2, wherein the middle-portion extends through the base.

4. The heat dissipating device of claim 1, further comprising a heat sink attached to a top of the base.

5. The heat dissipating device of claim 4, wherein the middle-portion of the heat pipe extends through an end of the heat sink.

6. The heat dissipating device of claim 5, wherein the end of the heat sink comprises a cavity therein receiving the middle-portion of the heat pipe.

7. The heat dissipation device of claim 1, wherein the condensing portion of the heat pipe is parallel to the evaporating portion of the heat pipe.

8. A method for manufacturing a heat dissipating device comprising steps of:

providing a base with a groove defined therein;

providing at least a heat pipe comprising an evaporating portion and at least a condensing portion, the evaporating portion thermally mounted in said groove with part thereof exposed outside of said groove;

machining said part of the evaporating portion and a bottom surface of the base to form a flat surface on the evaporating portion coplanar with the bottom surface of the base; and providing fins thermally attached with the at least a condensing portion of the heat pipe.

9. The method as claimed in claim 8, wherein said part of the evaporating portion is milled to form said flat surface.

10. A heat dissipating device comprising:

a base for absorbing heat from a heat-generating component;

a first heat sink provided on the base;

a heat pipe comprising an evaporating portion arranged between the base and the first heat sink, a middle portion bent from the evaporating portion and received in the first heat sink, and a condensing portion bent from the middle portion and extending away from the base; and a second heat sink attached to the condensing portion of the heat pipe.

11. The heat dissipating device of claim 10, wherein the evaporating portion and the condensing portion extend from opposite ends of the middle portion in opposite directions.

12. The heat dissipating device of claim 11, wherein the base defines a slot and the evaporating portion of the heat pipe is completely received in the slot for absorbing heat from the heat-generating component directly.

13. The heat dissipating device of claim 10, wherein the second heat sink offsets from the first heat sink in a direction parallel to the base and offsets from the base in a direction perpendicular to the base.

14. The heat dissipating device of claim 13, wherein the first heat sink defines a cavity at one side thereof for receiving the middle-portion of the heat pipe.

15. A heat dissipating device comprising:

a base;

a plurality of heat-dissipating fins; and at least one heat pipe, said heat pipe comprising an evaporating portion attached to the base, a middle-portion and a condensing portion extending through the fins;

wherein a bottom of the evaporating portion of said heat pipe and the base are coplanar, the condensing portion extends opposite to the evaporating portion, the middle-portion of said heat pipe is a curved-portion, and the middle-portion extends through the base.

16. The heat dissipating device of claim 15, further comprising a heat sink attached to a top of the base.

17. The heat dissipating device of claim 16, wherein the middle portion of the heat pipe extends through an end of the heat sink.

18. The heat dissipating device of claim 17, wherein the end of the heat sink comprises a cavity therein receiving the middle-portion of the heat pipe.

* * * * *

US007028758C1

(12) EX PARTE REEXAMINATION CERTIFICATE (8535th)

United States Patent

Sheng et al.

(10) Number: US 7,028,758 C1

(45) Certificate Issued: Sep. 13, 2011

(54) HEAT DISSIPATING DEVICE WITH HEAT PIPE

(75) Inventors: Jian-Qing Sheng, Shenzhen (CN); Meng-Tzu Lee, Tu-Cheng (TW); Shu-Ho Lin, Tu-Cheng (TW)

(73) Assignee: Hon Hai Precision Industry Co., Ltd., Tu-Cheng, Taipei Hsien (TW)

Reexamination Request:
No. 90/010,859, Apr. 2, 2010

Reexamination Certificate for:

| | |
|---|---|
| Patent No.: | **7,028,758** |
| Issued: | **Apr. 18, 2006** |
| Appl. No.: | **11/019,340** |
| Filed: | **Dec. 21, 2004** |

(51) Int. Cl.
*F28D 15/00* (2006.01)

(52) U.S. Cl. ..... 165/104.21; 165/104.26; 165/104.33; 361/700; 361/697; 174/15.2; 257/715

(58) Field of Classification Search ..... 165/104
See application file for complete search history.

(56) References Cited

U.S. PATENT DOCUMENTS

| | | | |
|---|---|---|---|
| 5,598,320 | A | 1/1997 | Toedtman et al. |
| 7,021,368 | B2 | 4/2006 | Lin et al. |
| 2003/0218849 | A1 | 11/2003 | Mochizuki et al. |
| 2004/0035558 | A1 | 2/2004 | Todd et al. |

*Primary Examiner*—Aaron J. Lewis

(57) ABSTRACT

A heat dissipating device incorporating heat pipes is disclosed. The heat dissipating device includes a base, a plurality of heat-dissipating fins and at least one heat pipe. The heat pipe includes an evaporating portion attached to the base, a middle-portion and a condensing portion extending through the fins. Bottoms of the evaporating portion of the heat pipe and the base are coplanar, and the condensing portion extends opposite to the evaporating portion.

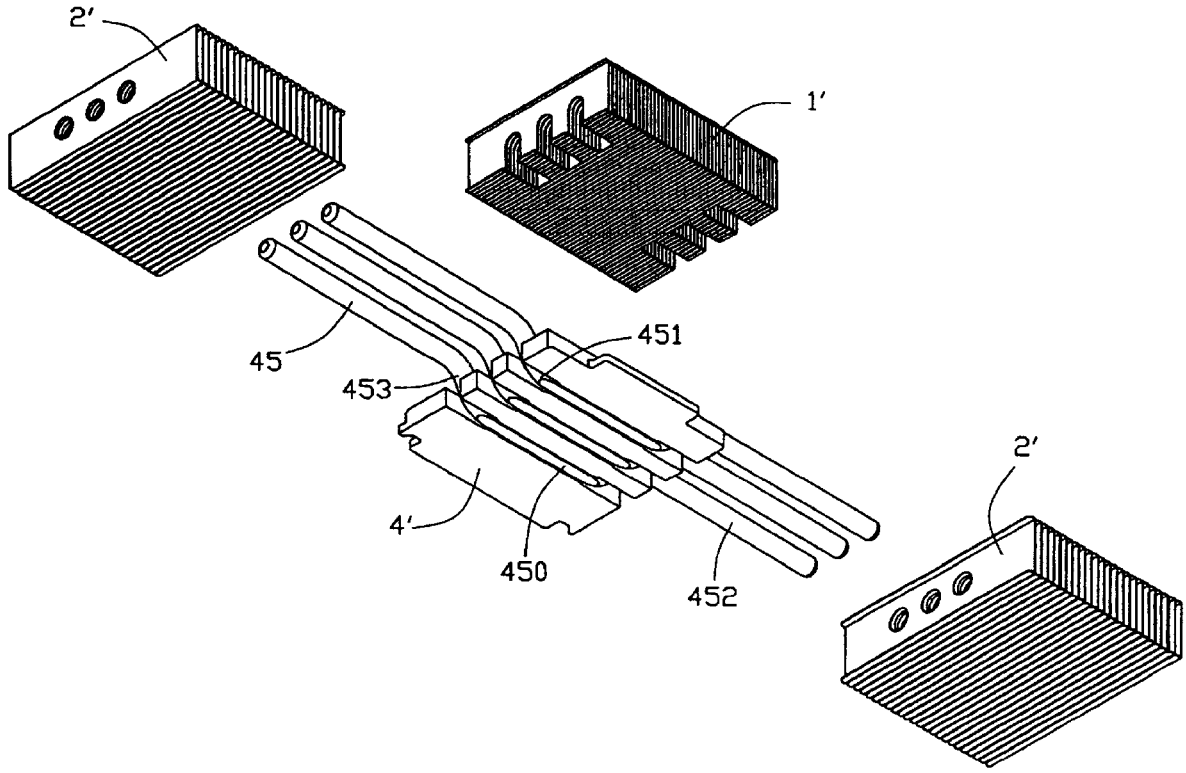

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-7, 11 and 15-18 are cancelled.

Claims 8, 10, 12 and 14 are determined to be patentable as amended.

Claims 9 and 13, dependent on an amended claim, are determined to be patentable.

8. A method for manufacturing a heat dissipating device comprising steps of:

providing a base with a groove defined therein;

providing at least a heat pipe comprising an evaporating portion and at least a condensing portion, the evaporating portion thermally mounted in said groove with part thereof exposed outside of said groove;

machining said part of the evaporating portion and a bottom surface of the base *simultaneously* to form a flat surface on the evaporating portion coplanar with the bottom surface of the base; and providing fins thermally attached with the at least a condensing portion of the heat pipe.

10. A heat dissipating device comprising:

a base for absorbing heat from a heat-generating component;

a first heat sink provided on the base;

a heat pipe comprising an evaporating portion arranged between the base and the first heat sink, a middle portion bent from the evaporating portion and received in the first heat sink, and a condensing portion bent from the middle portion and extending away from the base; and a second heat sink attached to the condensing portion of the heat pipe*;*

*wherein the evaporating portion and the condensing portion extend from opposite ends of the middle portion in opposite directions*.

12. The heat dissipating device of claim [11] *10*, wherein the base defines a slot and the evaporating portion of the heat pipe is completely received in the slot for absorbing heat from the heat-generating component directly.

14. The heat dissipating device of claim 13, wherein the first heat sink defines a cavity at one side thereof for receiving the [middle-portion] *middle portion* of the heat pipe.

* * * * *